US006505760B1

(12) United States Patent
Werner

(10) Patent No.: US 6,505,760 B1
(45) Date of Patent: Jan. 14, 2003

(54) SEED BOX TOTE

(75) Inventor: Norbert E. Werner, Dodge City, KS (US)

(73) Assignee: Crustbuster/Speed King, Dodge City, KS (US)

( * ) Notice: Subject to any disclaimer, the term of this patent is extended or adjusted under 35 U.S.C. 154(b) by 0 days.

(21) Appl. No.: 09/941,074

(22) Filed: Aug. 28, 2001

(51) Int. Cl.[7] ..... B67D 5/06

(52) U.S. Cl. ..... 222/185.1; 222/533; 222/542; 222/561; 222/518

(58) Field of Search ..... 222/129, 181.2, 222/185.1, 533, 542, 561, 518

(56) References Cited

U.S. PATENT DOCUMENTS

| | | | | |
|---|---|---|---|---|
| 3,123,107 A | | 3/1964 | Kappler | 141/352 |
| 3,318,473 A | | 5/1967 | Jones et al. | 214/621 |
| 3,354,918 A | | 11/1967 | Coleman | 141/363 |
| 3,764,026 A | | 10/1973 | Emmerich | 214/35 R |
| 3,765,579 A | * | 10/1973 | Cramer et al. | 222/561 |
| 4,073,410 A | * | 2/1978 | Melcher | 222/181.3 |
| 4,491,253 A | | 1/1985 | Coleman | 222/559 |
| 4,690,307 A | * | 9/1987 | Hogan | 222/181.3 |
| 4,785,966 A | | 11/1988 | Waltke | 220/345 |
| 4,856,681 A | * | 8/1989 | Murray | 222/181.2 |
| 5,697,535 A | | 12/1997 | Coleman | 222/542 |
| 5,971,219 A | * | 10/1999 | Karpisek | 222/185.1 |

* cited by examiner

*Primary Examiner*—Joseph A. Kaufman
(74) *Attorney, Agent, or Firm*—Wm Bruce Day

(57) ABSTRACT

A seed dispensing apparatus comprises a support frame adapted to receive a separate seed bin and with a down spout positioned within the support frame and connected to a delivery conveyor for transporting seed from the bin to a seeder implement. A seal arrangement in the support frame substantially eliminates leakage of expensive seed from the seed bin. The seal arrangement consists of upper and lower telescoping seal parts which are spring biased to an extended position so that when the seed bin is placed on the support frame, the outlet of the seed bin bears against the seal arrangement which is kept in tight engagement with the outlet to prevent seed leakage.

3 Claims, 3 Drawing Sheets

SEED BOX TOTE

FIELD OF THE INVENTION

This invention relates to seed handling equipment and particularly to such seed handling equipment involved in transferring expensive hybrid seed from a seed bin to seeder implements.

BACKGROUND OF THE INVENTION

Large scale users of hybrid seed are now supplied the seed in plastic seed boxes which typically hold 58 cubic feet and are dimensioned 565" L, 45" W, 65" H. When full, a seed box typically weighs approximately 2800 lbs. Small users of seed may still purchase seed in 50 lbs. bags which are then unloaded into seed receiving bins mounted on seeders and planters in the heretofore usual way; that is, the bag is opened, lifted and dumped into the seed receiving receptacle. With the advent of larger farms, use of 50 lb. seed bags has become too labor intensive for large scale producers who more efficiently purchase seed in seed boxes. There are several bulk seed delivery systems now present for the large scale farmer to choose from. All of these systems mount and elevate the seed box on a support frame and employ a conveyor system to deliver the seed from the seed box to the planter/seeder bins. The frame may be capable of holding one, two or four seed boxes. Each seed box includes a bottom sliding gate which is manually opened or closed and which dumps seed through a rectangular outlet in the center bottom of the seed box. From there, the seed falls through a downspout and dumps into the tail of a conveyor. Typically, the conveyor is mounted on the support frame for swinging movement and telescoping movement so as to dump the seed load into planter/seeder holding bins. The seed boxes are lifted into and out of position on the support frames by forklifts and as a result, the large scale farmer maintains the seed bin handling equipment at farm headquarters and hauls the seed boxes from the elevator by truck.

Increasingly, the large scale farmer who seeks to maximize efficiency plants expensive hybrid seed. Spillage and wastage of expensive seed is no longer tolerable and increased efficiencies in both the seed delivery systems and the seed planter/seeder implement system is required. The present invention seeks to reduce and/or substantially eliminate spillage or wastage of seed in the seed delivery system extending between the seed box and the planter. Improvements have been made in the conveyor for efficient sealing of the conveyor belt with conveyor tube walls and efficiencies have been improved in the delivery of the seed from the seed box into the downspout and into the receiving end of the conveyor. The present invention focuses upon a leak-free or substantially leak-free seal between the conveyor frame delivery system and the outlet of the seed box.

A SUMMARY OF THE INVENTION

A seed dispensing delivery system consists of a support frame apparatus on which is placed one or more seed boxes. A downspout positioned within the frame connects to a delivery conveyor for transporting seed from the seed bins to a seeder implement. A seal arrangement in the support frame receives and registers with a seed bin outlet to pass the seed into the downspout. The seal arrangement is spring biased into a secure, substantially leak-free arrangement with the seed bin outlet.

OBJECTS OF THE INVENTION

The objects of the present invention are; to provide an effective and leak-free or at least substantially leak-free seal between a seed box and the associated seed delivery system; to provide such a device which is simple and efficient in construction; to provide such a device which is well suited to the purpose for which it is intended.

Other objects and advantages of the invention will be apparent from the following description.

DESCRIPTION OF THE PREFERRED EMBODIMENT

Detailed embodiments of the invention are disclosed herein, however, it is to be understood that the disclosed embodiments are merely exemplary of the invention which may be embodied in various forms. Therefore, specific structural and functional details disclosed herein are not be interpreted as limiting, but rather merely as a basis for teaching one skilled in the art to variously employ the present invention in any appropriately detailed form, and as a basis for the claims.

Figure 1:
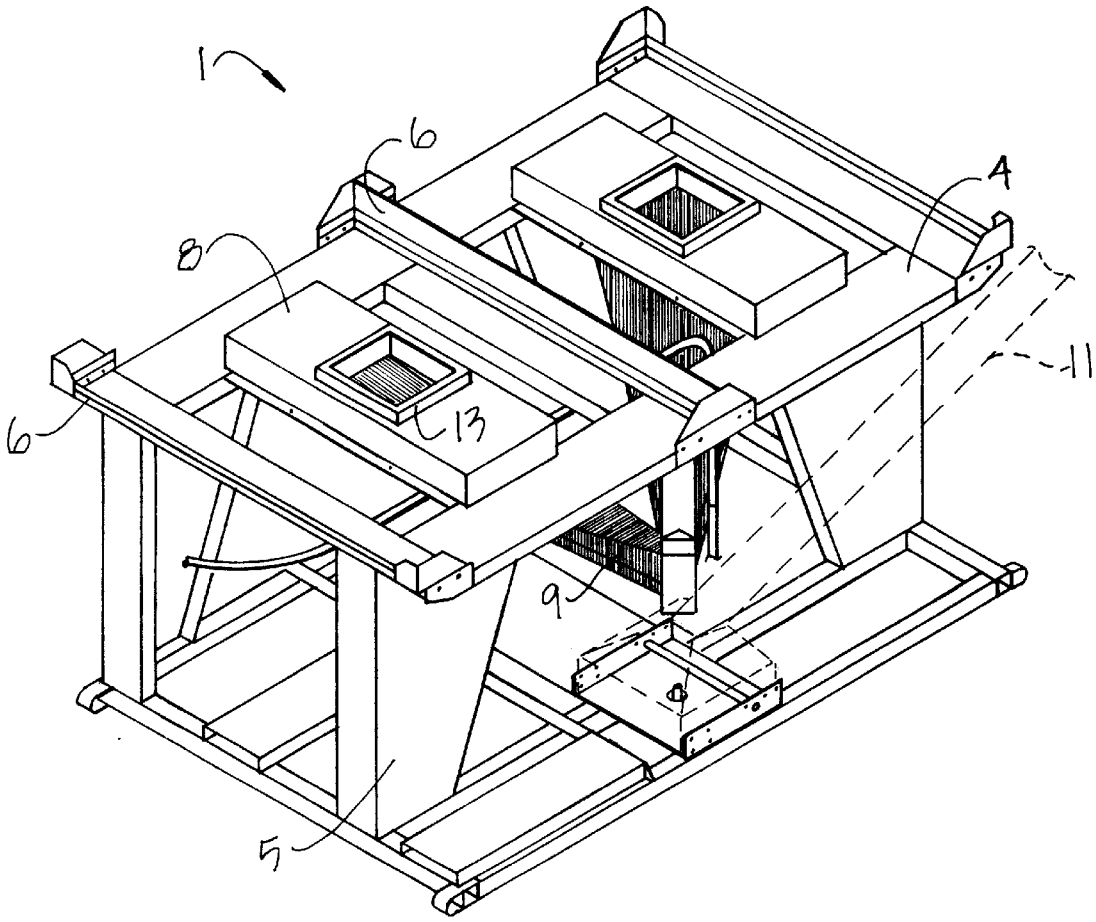
FIG. 1 is a perspective view of a seed box tote mechanism embodying the present invention.

The reference numeral 1, FIG. 1 generally designates a seed box tote embodying the present invention. The seed box tote 1 may be constructed to handle a single seed bin 2 or two such seed bins, as shown in FIG. 1. Each seed bin 2 is a large box-like structure forming a container for seeds. Hybrid seed growers commonly sell such premium seeds in seed bins 2. Each seed bin commonly has rails for loading via a fork lift truck and a slidable gate located at the bottom of the bin for emptying seed from the bin. The tote 1 generally includes a frame 4 with legs 5 elevating the frame 4 above a ground surface. Guides 6 position the bin 2 on the frame 4.

The seed box tote 1 includes an outlet 8 communicating with an outlet spout 9 through which the seed travels from the seed bin 2. The outlet spout 9 terminates at the entry of a delivery conveyor 11, such as a belt or auger mechanism conveyor, which transports the seed to a seeder implement (not shown). The implement may be a corn planter, grain drill or other such implement.

Figure 2:
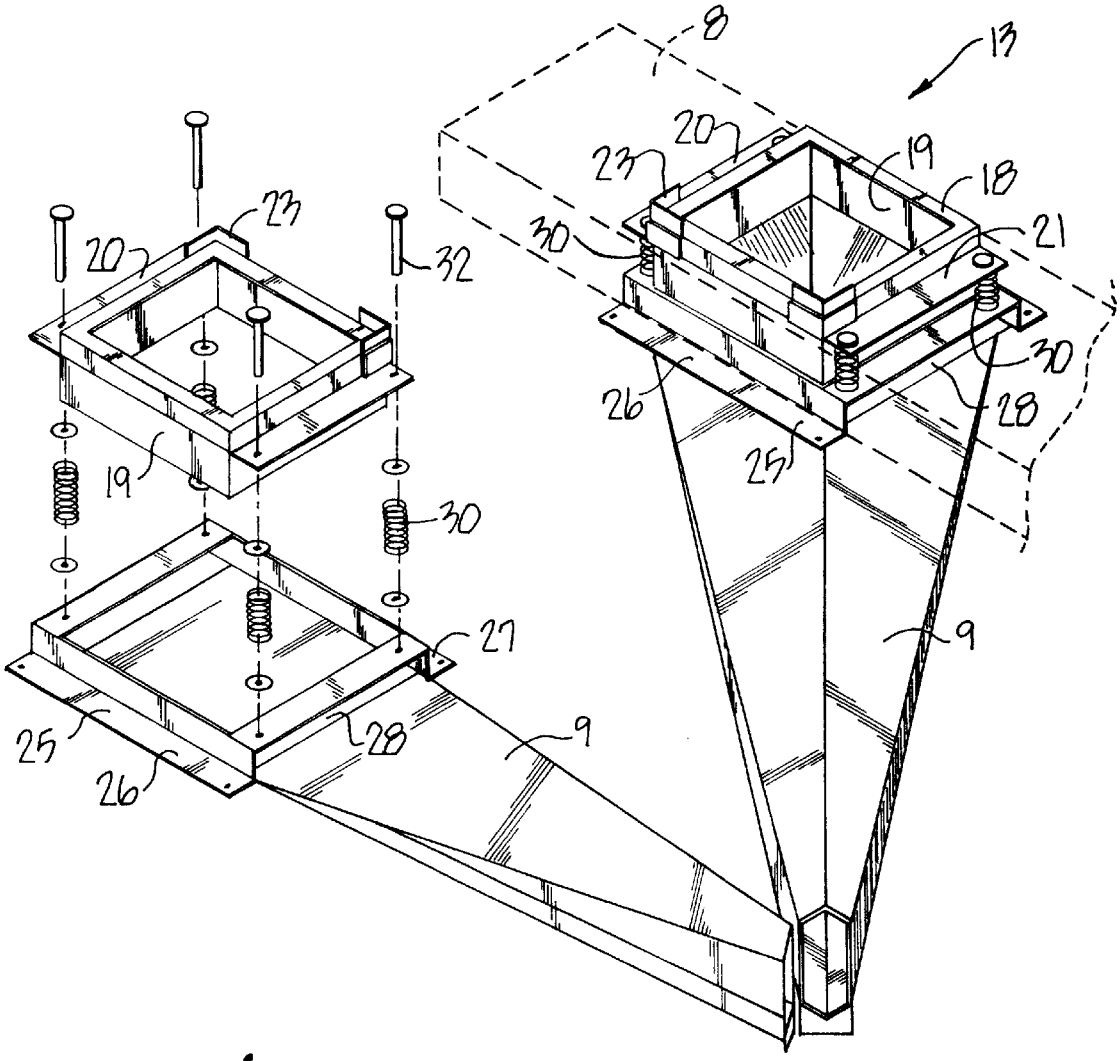
FIG. 2 is a disassembled perspective view of a seal arrangement between a seed box and the associated seed delivery system, which embodies the present invention.

Generally, all of the above identified features are common to seed box totes available in the industry. The present seed box tote has an outlet seal 13 of unique design and in conjunction with the seed box tote 1 as a whole is the subject matter for which this disclosure and patent are directed to. The outlet seal 13 is biased to an extended position so as to fit tightly against the outlet 15 of the bin 2. The bin outlet 15 is of generally rectangular configuration and is opened and closed by a simple slide gate 16 accessible from the side of the bin 2. The outlet seal 13, FIG. 2, comprises an upper frame 18 of rectangular formation and including a depending peripheral skirt 19 and side flanges 20 and 21. Comer guides 23 aid in positioning the upper frame 18 relative to the bin outlet 15. The upper frame 18 partially slides down into a lower frame 25 which is sized to snugly receive the skirt 19. The lower frame 25 has opposite mounting flanges 26 and 27 extending from peripheral side walls 28. The mounting flanges 26 and 27 secure to the cross beam forming a support for the outlet 8. The upper frame 18 reciprocates relative to the lower frame 25 via a biasing means such as springs 30. As shown in FIG. 2, elongate bolts or fasteners 32 extend downwardly from corners of the flanges 20 and 21 into the lower frame 25. The fasteners 32 are of such a length that the frame 18 moves up and down relative to the frame 25 and is biased to an upward position by the springs 30. Other biasing means such as leaf springs, rubber bumpers and the like may be used as desired to bias the upper frame 18 to an extended position.

Figure 3:
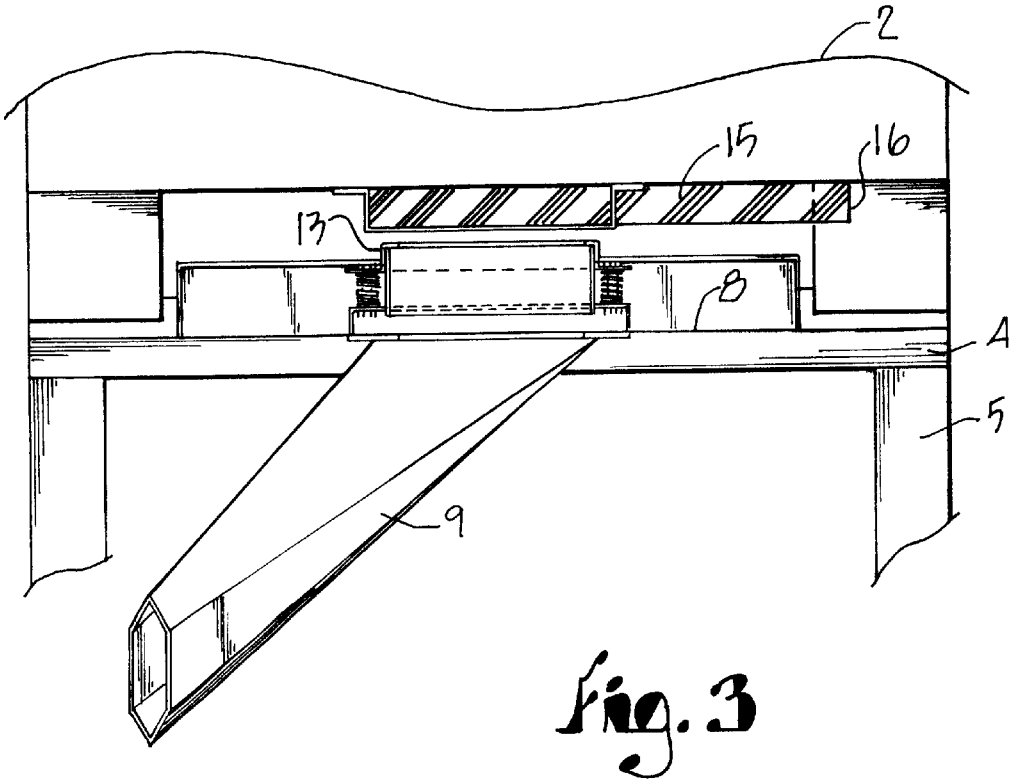
FIG. 3 is a sectional view showing the seal arrangement before engagement with the outlet of a seed box.
Figure 4:
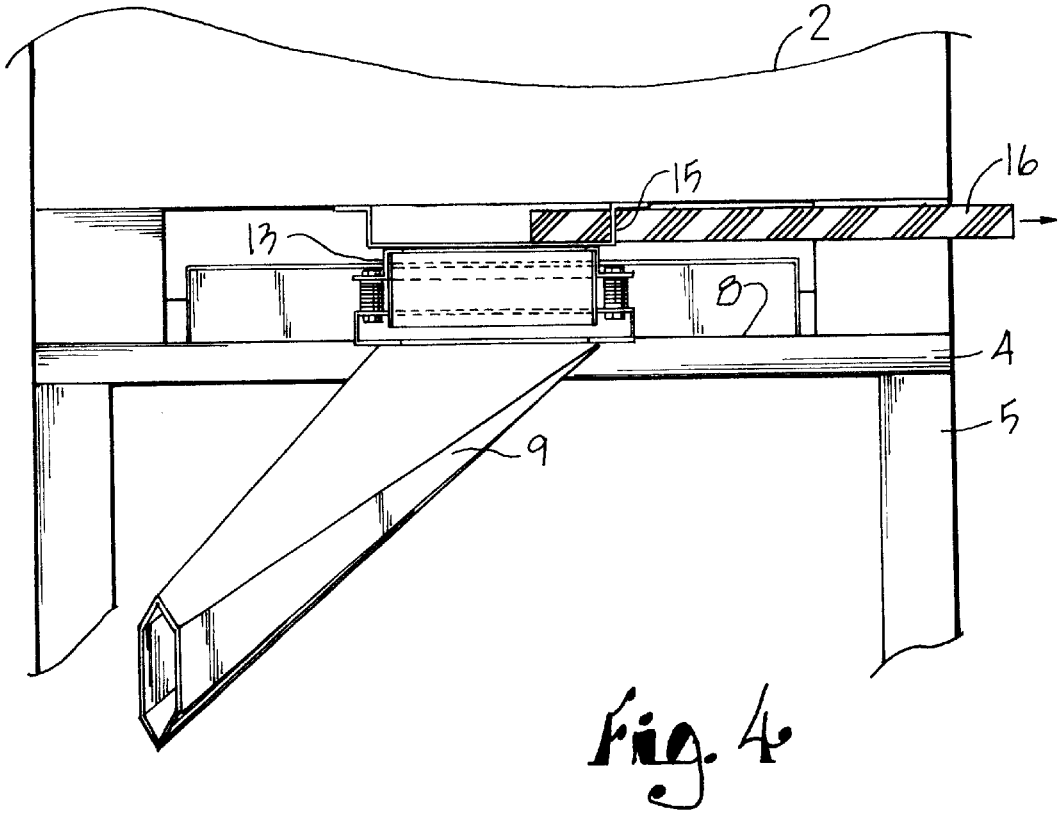
FIG. 4 is a sectional view showing the seal arrangement in engagement with the outlet of a seed bin.

As shown in FIG. 3, the upper frame 18 is normally in an extended position in the absence of a load placed thereon. FIG. 3 shows a seed bin in position on the seed box tote frame 4 and in the process of being lowered thereon, such as by fork lift. The springs 30 extend the upper frame upwardly. As the bin 2 is lowered and the bin outlet 15 bears against the upper frame 18, the springs 30 compress to maintain a tight seal against the bin outlet 15. The bin 2 is fully lowered to the tote frame 4 and the slide gate 16 pulled open, allowing seed to fall through the bin outlet 15, through the outlet seal 13 and down into the outlet spout 9. By the use of this invention, no or little valuable seed is lost because of the tight connection maintained between the tote outlet seal 13 and the bin outlet 15.

What is claimed and desired to be protected by Letters Patent is:

1. An unloading apparatus for a seed box having a bottom with an outlet and a gate selectively transversely moving across and closing said outlet, the unloading apparatus comprising a support frame for positioning the seed box thereon, a downspout mounted within said frame and connecting to a delivery conveyor for transporting seed from said box to a seeder implement, and a seal arrangement mounted in said support frame and positioned between the seed bin outlet and the downspout, the seal arrangement having upper and lower portions, the upper portion spring biased to an extended position so as to mate with and seal against the seed box outlet so that when said gate is opened, no or minimal seed is lost.

2. The seed dispensing apparatus set forth in claim 1 wherein said seal arrangement includes upper and lower spout frames, the upper spout frame collapsing downwardly into the lower spout frame when urged downwardly by the weight of a seed bin placed thereon.

3. The seed dispensing apparatus set forth in claim 2 wherein there are springs extending between said upper and lower spout frames to urge said upper spout frame snugly against said seed bin when placed thereon.

* * * * *